United States Patent [19]

Van Elk

[11] Patent Number: 4,969,071

[45] Date of Patent: Nov. 6, 1990

[54] ILLUMINATION SET

[75] Inventor: Alfred H. Van Elk, Eindhoven, Netherlands

[73] Assignee: U.S. Philips Corporation, New York, N.Y.

[21] Appl. No.: 349,726

[22] Filed: May 10, 1989

[30] Foreign Application Priority Data

Jun. 13, 1988 [NL] Netherlands ..... 8801503

[51] Int. Cl.[5] ..... F21V 21/00

[52] U.S. Cl. ..... 362/249; 362/238; 362/396; 439/280; 439/575

[58] Field of Search ..... 362/226, 227, 237, 238, 362/249, 396; 439/414, 280, 575

[56] References Cited

U.S. PATENT DOCUMENTS

| | | | |
|---|---|---|---|
| 1,974,472 | 9/1934 | Seghers | 362/249 X |
| 2,453,695 | 3/1946 | Belling | 362/396 |
| 2,506,620 | 5/1950 | Sundt | 362/368 |
| 2,657,367 | 10/1953 | Brooks | 362/396 X |
| 3,206,712 | 9/1965 | Schick et al. | 439/419 |
| 3,340,390 | 9/1967 | Imre | 362/396 X |
| 3,386,070 | 5/1968 | Jansson et al. | 439/123 |
| 3,601,767 | 8/1971 | Eckles | 439/419 |
| 3,609,643 | 9/1971 | Connan | 439/419 |
| 3,770,951 | 11/1973 | Corelli et al. | 362/249 |
| 4,159,157 | 6/1979 | Koehler | 439/419 X |
| 4,631,650 | 12/1986 | Ahroni | 362/249 |
| 4,777,573 | 10/1988 | Liao | 362/249 |
| 4,779,177 | 10/1988 | Ahroni | 362/236 |

*Primary Examiner*—Stephen F. Husar
*Attorney, Agent, or Firm*—Robert J. Kraus

[57] ABSTRACT

The illumination set has several lamp sockets, which are arranged as a string by an electrical cable (104). Each lamp socket has a housing (121), which is composed of a sleeve (128) and two oppositely positioned inner parts (126, 127) carrying contact members (124, 125) connected to the cable (104). The inner parts (126, 127) at the same time constitute a bottom part (132), consist of a thermoplastic synthetic material and are interconnected by a pivot (133), which is integral therewith. The lamp socket can have a clamping member (107), which is integral with the inner parts (126, 127) and consists of two facing rings (140, 141), which have profiled surfaces (142, 143).

19 Claims, 4 Drawing Sheets

ILLUMINATION SET

The invention relates to an illumination set comprising several lamp sockets arranged as a string by an electrically conducting cable carrying a pair of contact pins, each lamp socket being provided with an electrically insulating housing provided with at least one opening through which the cable is passed, contact members electrically connected to the electrically conducting cable to establish contact with a lamp base of an electric lamp to be arranged in the lamp socket, a clamping member for securing the lamp socket to a support, the electrically insulating housing comprising two oppositely positioned cooperating inner parts of synthetic material carrying the contact members and a sleeve having a longitudinal direction, which sleeve accommodates these cooperating inner parts and is open at a first end to provide access for a lamp base to the contact members and has at a second end a bottom part connected to the clamping member.

Such a set is known from U.S. Pat. No. 3,386,070.

For the manufacture of the known set, a large number of component parts have to be joined, which leads to an expensive product due to the time required.

In the manufacture of the known set, the cooperating inner parts of synthetic material are joined with the interposition of the contact members and are arranged in the sleeve. The bottom part is composed of two halves around the sleeve with the interposition of the clamping member in engagement with said sleeve and is fixed by a rivet, whereupon an annular part is arranged to surround the sleeve and the bottom part to cover the rivet.

The invention has for its object to provide an illumination set of the kind described in the opening paragraph, which has a simpler construction, which can be readily composed of a small number of component parts, which parts can be obtained in a reliable manner by simple means.

In the illumination set according to the invention, this object is achieved in that the two oppositely positioned cooperating inner parts at the same time constitute the bottom part, consist of a thermoplastic synthetic material and are interconnected by a pivot which is integral therewith.

Due to the integration of the bottom part and the two cooperating inner parts and due to the fact that the two cooperating inner parts are joined by a pivot, the number of component parts to be assembled is already reduced considerably. Further there is no longer any need of a rivet or the like and of a ring to cover the latter. Due to the pivot connection between the two cooperating inner parts, these parts can be readily oppositely positioned without it being necessary to align them with respect to each other after the contact members with the electrically conducting cable connected thereto have been arranged.

It is easy and efficient to pass the cable at the separation surface of the two cooperating inner parts. This is easy because the cable now need not be inserted through an opening and it is efficient because the cable can be held clamped between the two inner parts, as a result of which the connection between the cable and the contact members cannot be subjected to tensile stress. The clamping effect of the cooperating inner parts on the cable is then caused by the sleeve surrounding the cooperating inner parts. In this case there is also a frictional coupling between the sleeve and the two cooperating inner parts.

In another embodiment, the cable is held clamped by the two oppositely positioned cooperating inner parts on the one hand and the sleeve on the other hand.

The coupling between the sleeve and the two cooperating inner parts may alternatively or moreover be obtained by a snap connection, for example by one or more cams in the sleeve, for example near the second end thereof, and one or more grooves in the outer surface of the two cooperating inner parts, or conversely, which groove (grooves) and cam (cams) are in engagement with each other.

There is a large freedom with respect to the choice of the point at which and the direction in which the cable enters the lamp socket. The cable may enter, for example, in the longitudinal direction of the sleeve, transversely to the longitudinal direction or in intermediate directions. The cable may enter along the bottom part, but may alternatively enter elsewhere along the two cooperating inner parts. For this purpose, a slot may be provided in the sleeve near its free end to receive the cable.

The pivot between the two cooperating inner parts may arbitrarily be positioned, for example so that the pivot axis extends parallel to the longitudinal direction of the sleeve or transversely thereto. In the latter case, it is useful to position the pivot near the first open end of the sleeve. It is then easiest to arrange the sleeve around the cooperating inner parts, for example in case the cable is held clamped between said parts. Further, this position of the pivot has the advantage that, as will also appear from the drawings, there is a larger freedom with respect to the shape of the bottom part.

When oppositely positioning the two cooperating inner parts, a holding part of the clamping member may also be interposed. This clamping member may be chosen from various shapes. The clamping member may have, for example, the shape similar to the clip of the aforementioned U.S. Pat. No. 3,386,070, the jaws being held closed by a spring, while they can be opened by exerting pressure on levers connected to said jaws. The clamping member may alternatively take the form of a paperclip or of a two- or multi-toothed fork, of which first teeth are arranged opposite to second teeth.

In a favourable embodiment, the clamping member has two facing rings, for example of synthetic material. The facing surfaces of the rings may be profiled, for example provided with pointed projections or may be ribbed to increase their grip on a support, for example a branch of a tree. If the rings are radially profiled or ribbed, they also have much grip on a support when it is clamped obliquely to the direction of the sleeve. The rings may be spaced apart locally, for example at the portions arranged opposite to the bottom part, for example by a distance of one mm or a few mms, in order to facilitate positioning on a support. Within the housing of the lamp socket the rings may be secured to each other or may be integral; they may have, for example, the key-ring configuration.

In a very attractive embodiment, the rings are integral with the housing, more particularly with the two cooperating inner parts of the lamp socket. In a variation thereof, which moreover can be readily manufactured, each ring is integral with a respective specimen of these two cooperating inner parts of synthetic material. This embodiment and the variation thereof have the advantage that the number of component parts to be assembled is still further reduced. The said variation further has the advantage that the facing surfaces of said rings can readily be given a ribbed structure or a differently profiled structure.

It has proved to be favourable if the rings are not entirely closed, but have just outside the housing of the lamp socket a gap, which for one ring is arranged diametrically with respect to the housing opposite to the other gap. This variation has the advantage that the rings of the clamping member, when clamping a comparatively thick support, occupy instead of a V-shaped position rather a U-shaped position with respect to each other so that they have a smaller tendency to expel the support. It has been found that consequently supports of varying thicknesses, for example in a given embodiment thicknesses of 4 to 8 mm, are kept very rigidly.

It is favourable for the stability of a lamp socket on a support when the largest width of the rings substantially coincides with the outer side of the bottom part of the housing. When a lamp socket is arranged with its clamping member on a support, the clamping member may then be slipped over the support until the support abuts against the bottom part. The support is then held by the clamping member at two points as remote from each other as possible, as a result of which the lamp socket has a high stability on the support.

It will be appreciated that not only circular rings, but also rings of other shapes, such as oval or polygonal shape, have the said properties. In an embodiment, in which arrangement on a support is strongly facilitated, those portions of the rings which are arranged opposite to the bottom part of the housing are kinked apart so that the distance between the rings over said kinked portion becomes smaller towards this bottom part. The same effect is obtained if the rings have at this area oblique edges directed towards each other and approaching each other towards the bottom part.

As synthetic materials for the housing of the lamp socket use may be made inter alia of POM (polyoxymethylene), polyamide, for example polyamide 6,6, or ABS (acrylnitrilbutadiene-styrene copolymer).

The illumination set may have a two-core cable, as a result of which the lamp sockets are connected electrically in parallel, or it may have a monocore cable, which has connected the lamp sockets electrically in series. When provided, for example, with incandescent lamps, the set may be used in a christmas tree or for creating festive illumination.

The illumination set according to the invention has a simple construction, which can readily be composed of a small number of component parts, which can be obtained in a reliable manner by simple means.

Embodiments of the set according to the invention are shown in the drawing. In the drawing.

Figure 2:
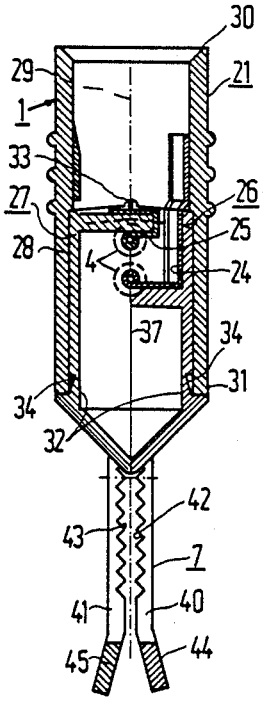
FIG. 2 is a longitudinal sectional view of a lamp socket of FIG. 1.
Figure 3:
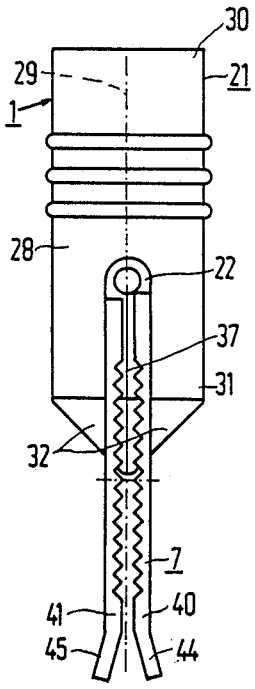
FIG. 3 is a side elevation of the lamp socket of FIG. 2.
Figure 4:
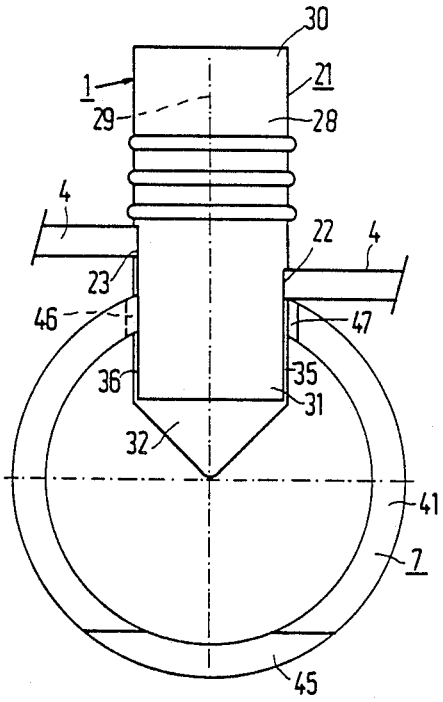
Figure 5:
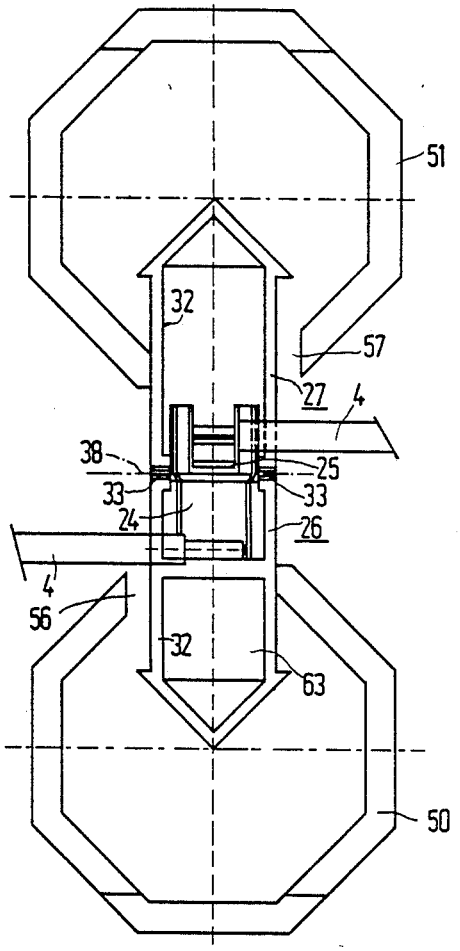
Figure 6:
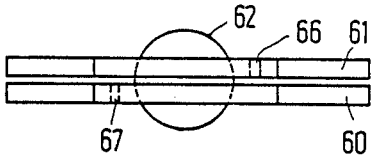
Figure 7:
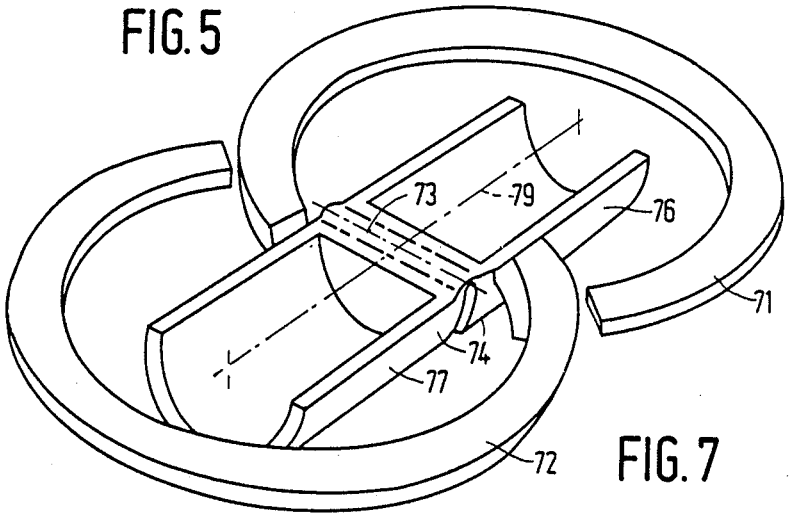
Figure 8:
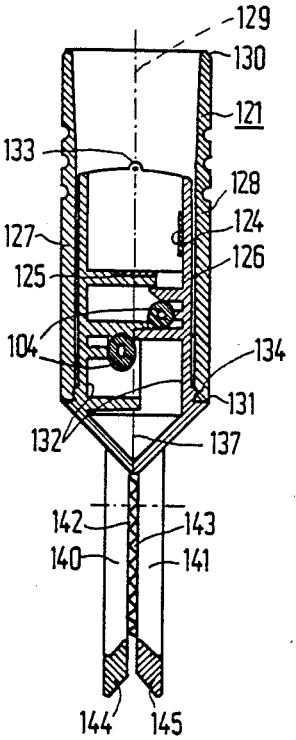
Figure 9:
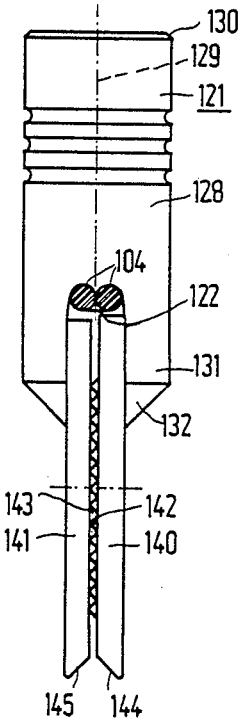
Figure 10:
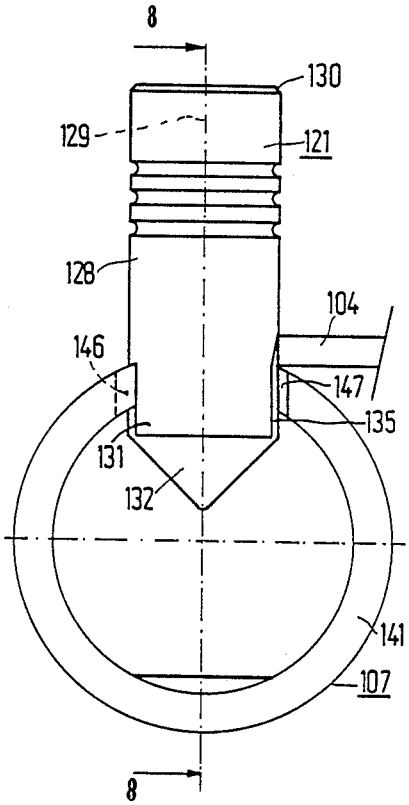
Figure 11:
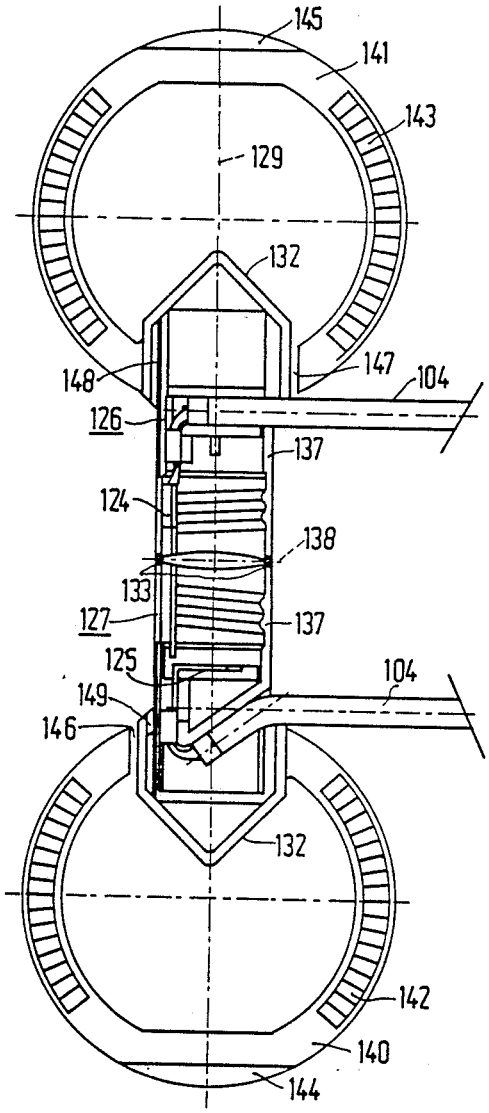

FIG. 4 is a side elevation of the lamp socket of FIG. 3 rotated through 90° about its longitudinal axis, FIG. 5 is a view of cooperating inner parts with another clamping member for use in the lamp socket of FIGS. 2–4 before being brought into opposition, FIG. 6 shows a separate clamping member, FIG. 7 shows a variation of FIG. 5, FIGS. 8–10 show a representation corresponding to FIGS. 2–4 of another embodiment of a lamp socket, FIG. 11 shows a view of cooperating inner parts for use in the lamp socket of FIGS. 8–10 before being brought into opposition.

Figure 1:
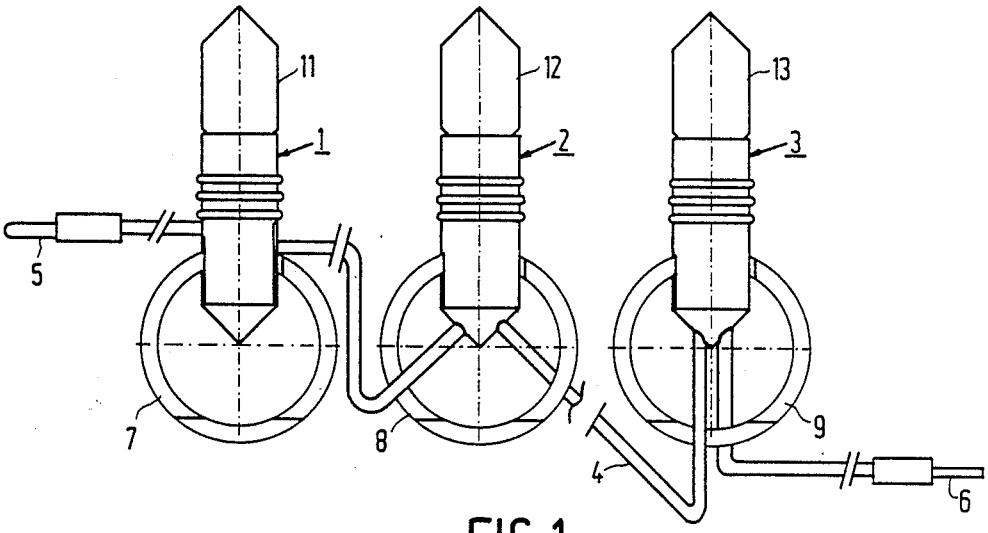
FIG. 1 is a side elevation of an illumination set.

In FIG. 1, the illumination set has several lamp sockets 1, 2, 3, which are arranged as a string by an electrically conducting cable 4, which carries a pair of contact pins 5, 6 for connecting the set to a source of supply. In the Figure, the cable 4 has one core and the lamp sockets 1, 2, 3 are electrically connected in series. The lamp sockets 1, 2, 3 have a respective clamping member 7, 8, 9 for securing the respective lamp socket to a support.

With the lamp socket 1, the cable 4 is passed at right angles to the longitudinal direction of the lamp socket, while with the lamp socket 2 this is effected at an angle of 45° and with the lamp socket 3 in the longitudinal direction of the lamp socket. In the Figure, each of the lamp sockets carries an electric incandescent lamp 11, 12 and 13, respectively.

In FIGS. 2–4, it is visible that the lamp socket 1 of FIG. 1 is provided, like the other lamp sockets, with an electrically insulating housing 21 with openings 22, 23, through which the cable 4 is passed. Contact members 24, 25 are connected to the cable 4 in an electrically conducting manner. They can get into contact with a lamp base of an electric lamp to be arranged in the lamp socket 1. The lamp socket 1 has a clamping member 7 for securing the lamp socket to a support. The electrically insulating housing 21 comprises two oppositely positioned cooperating inner parts 26, 27 of synthetic material, which carry the contact members 24, 25, and further a sleeve 28 having a longitudinal direction 29, which sleeve accommodates these cooperating inner parts. The sleeve 28 is open at a first end 30 to provide access for a lamp base to the contact members 24, 25 and has at a second end 31 a bottom part 32, which is connected to the clamping member 7.

In the lamp socket 1, the two oppositely positioned cooperating inner parts 26, 27 at the same time constitute the bottom part 32, consist of a thermoplastic synthetic material i.e. polyamide 6,6 and are interconnected by a pivot 33 (see also FIG. 5), which is integral therewith. The pivot 33 is rotatable about an axis transverse to the longitudinal direction 29 of the sleeve 28. The pivot is situated near the open end 30 of the sleeve 28.

Between the sleeve 28 and the two oppositely positioned cooperating inner parts 26, 27 is established a snap connection 34 (FIG. 2), which in the Figure is formed by a cam at the inner surface of the sleeve 28 near its second end 31 and a groove in the cooperating inner parts 26, 27.

The clamping member 7 has two facing rings 40, 41, whose facing surfaces 42, 43 are ribbed. The rings are spaced apart and have opposite to the bottom part 32 an outwardly kinked portion 44, 45. In FIGS. 2–4, the rings are circular. Their largest width, i.e. their diameter, lies near the outer surface of the bottom part 32.

The rings 40, 41 are not entirely closed, but each have just outside the housing 21 a gap 46 and 47, respectively, which gaps are arranged diametrically opposite to each other with respect to the housing 21. The rings 40, 41 are each integral with the housing 21 and more particularly integral with the cooperating inner parts 26, 27, in FIGS. 2–4 with a respective cooperating inner part 26, 27. The sleeve 28 has slots 35, 36, through which the cable 4 and the rings 40, 41 extend to the exterior. The cable 4 is passed at the separation surface 37 of the cooperating inner parts 26, 27 and clamped between these parts.

In FIG. 5, in which parts corresponding to parts of FIGS. 2–4 have the same reference numerals, the rings 50, 51 of the clamping member have a polygonal shape with gaps 56 and 57, respectively. The two cooperating inner parts 26, 27 have not yet been oppositely positioned.

It is clearly visible in the Figure that the pivot 33 is bi-partite. Its axis 38 is located transversely to the longitudinal direction of a sleeve to be arranged.

In FIG. 6, the clamping member has polygonal rings 60, 61 (like in FIG. 5) with gaps 66 and 67, respectively, which are integral with a cylinder 62 as holding part for the clamping member. The clamping member can be used in the part of FIG. 5 in the absence of its rings 50, 51 by accommodating the cylinder 62 in the cavity 63. When oppositely positioning the cooperating inner parts 26, 27, the clamping member of FIG. 6 is then enclosed. The clamping member of FIG. 6 may also be composed of two, for example identical parts by cutting the cylinder along a plane parallel to the rings.

In FIG. 7, the two cooperating inner parts 76, 77 are interconnected at their bottom part 74 by a pivot 73. They are integral with rings 71 and 72, respectively. The bottom part 74 extends at right angles to the longitudinal direction 79 and is substantially flat or alternatively for example roof-shaped. With for example a conical bottom part, the pivot would have only a very small dimension in its axial direction and hence little stability.

In FIGS. 8–11, parts corresponding to parts of FIGS. 2–5 have a reference numeral which is 100 higher.

The lamp socket has a housing 121 with only one opening 122 (FIG. 9) for the cable 104. The cable 104 is held clamped by the cooperating inner parts 126, 127 or alternatively by these inner parts and the sleeve 128.

The rings 140, 141 of the clamping member 107 are radially ribbed at their facing surfaces 142, 143. The surfaces 142, 143 are in engagement with each other. The rings 140, 141 are opposite to the bottom part 132 at a certain distance from each other and they have facing oblique edges 144, 145, which approach each other towards the bottom part 132. The clamping member consequently has a large clamping force also on a thin support, but nevertheless the clamping member can readily be arranged on a support. Due to the fact that the surfaces 142, 143 are radially ribbed, also a support accommodated obliquely to the longitudinal direction 129 can be firmly held by the clamping member 107.

The cooperating inner parts 126, 127 have a cam 148 and a groove 149, which, after the inner parts have been oppositely positioned, are in engagement with each other and constitute a lock against lateral displacement. Their inner surface is profiled so as to form together screw-thread for a lamp base (FIG. 11).

What is claimed is:

1. An illumination set comprising several lamp sockets (1, 2, 3) arranged as a string by an electrically conducting cable (4, 104) carrying a pair of contact pins (6, 7), each lamp socket being provided with an electrically insulating housing (21, 121) provided with at least one opening (22, 23, 122), through which the cable is passed, contact members (25, 26, 125, 126), electrically connected to the electrically conducting cable, to establish contact with a lamp base of an electric lamp to be arranged in the lamp socket, a clamping member (7, 107) for securing the lamp socket to a support, the electrically insulating housing comprising two oppositely positioned cooperating inner parts (26, 27, 126, 127) of synthetic material carrying the contact members and a sleeve (28, 128) having a longitudinal direction (29, 129), which sleeve accommodates these cooperating inner parts and is open at a first end (30, 130) to provide access for a lamp base to the contact members and has at a second end (31, 131) a bottom part (32, 132) connected to the clamping member, characterized in that the two oppositely positioned cooperating inner parts (26, 27, 126, 127) at the same time constitute the bottom part (32, 132), consist of a thermoplastic synthetic material and are interconnected by a pivot (33, 133), which is integral therewith.

2. An illumination set as claimed in claim 1, characterized in that the pivot (33, 133) is rotatable about an axis (38, 138) extending at right angles to the longitudinal direction (29, 129) of the sleeve (28, 128).

3. An illumination set as claimed in claim 2, characterized in that the pivot (33, 133) is situated near the open end (30, 130) of the sleeve (28, 128).

4. An illumination set as claimed in claim 2, characterized in that the clamping member (7, 107) has two facing rings (40, 41, 140, 141) with facing profiled surfaces (42, 43, 142, 143).

5. An illumination set as claimed in claim 4, characterized in that the rings (40, 41, 140, 141) are integral with the housing (21, 121).

6. An illumination set as claimed in claim 5, characterized in that the rings are integral with the two cooperating inner parts (26, 27, 126, 127).

7. An illumination set as claimed in claim 6, characterized in that the rings are integral with a respective inner part (26, 27, 126, 127).

8. An illumination set as claimed in claim 7, characterized in that the rings each have a gap 46, 47, 146, 147) just outside the housing (21, 121), the gaps being positioned diametrically opposite to each other with respect to the housing.

9. An illumination set as claimed in claim 8, characterized in that the outer surface at the bottom part (32, 132) lies near the largest dimension of the rings (40, 41, 140, 141).

10. An illumination set as claimed in claim 9, characterized in that the rings (40, 41) have opposite to the bottom part (32) an outwardly kinked portion (44, 45).

11. An illumination set as claimed in claim 9, characterized in that the rings (140, 141) have facing oblique edges (144, 145) opposite to the bottom part (132).

12. An illumination set as claimed in claim 11, characterized in that the facing surfaces (142, 143) of the rings (140, 141) are radially ribbed.

13. An illumination set as claimed in claim 12, characterized in that the facing surfaces (142, 143) are in engagement with each other.

14. An illumination set as claimed in claim 1, characterized in that the clamping member (7, 107) has two facing rings (40, 41, 140, 141) with facing profiled surfaces (42, 43, 142, 143).

15. An illumination set as claimed in claim 4, characterized in that the rings each have a gap (46, 47, 146, 147) just outside the housing (21, 121), the gaps being positioned diametrically opposite to each other with respect to the housing.

16. An illumination set as claimed in claim 4, characterized in that the outer surface at the bottom part (32, 132) lies near the largest dimension of the rings (40, 41, 140, 141).

17. An illumination set as claimed in claim 4, characterized in that the rings (40, 41) have opposite to the bottom part (32) an outwardly kinked portion (44, 45).

18. An illumination set as claimed in claim 4, characterized in that the rings (140, 141) have facing oblique edges (144, 145) opposite to the bottom part (132).

19. An illumination set as claimed in claim 4, characterized in that the facing surfaces (142, 143) of the rings (140, 141) are radially ribbed.

* * * * *